US008992802B2

(12) United States Patent
Wu

(10) Patent No.: US 8,992,802 B2
(45) Date of Patent: Mar. 31, 2015

(54) CROSSLINKED POLY(ETHER ETHER KETONE) INTERMEDIATE TRANSFER MEMBERS

(71) Applicant: Xerox Corporation, Norwalk, CT (US)

(72) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 13/773,607

(22) Filed: Feb. 21, 2013

(65) Prior Publication Data

US 2014/0231722 A1 Aug. 21, 2014

(51) Int. Cl.
*H01B 1/12* (2006.01)
*G03G 15/16* (2006.01)

(52) U.S. Cl.
CPC ..... *G03G 15/162* (2013.01)
USPC ..... 252/511; 252/510; 252/500; 399/176; 399/286; 528/125; 528/219; 525/471; 524/500; 428/332

(58) Field of Classification Search
None
See application file for complete search history.

(56) References Cited

U.S. PATENT DOCUMENTS

| | | | | |
|---|---|---|---|---|
| 5,487,707 | A | 1/1996 | Sharf et al. | |
| 5,922,440 | A | 7/1999 | Schlueter, Jr. et al. | |
| 6,318,223 | B1 | 11/2001 | Yu et al. | |
| 6,397,034 | B1 | 5/2002 | Tarnawskj et al. | |
| 6,440,515 | B1 | 8/2002 | Thorton et al. | |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 8,252,420 | B2 | 8/2012 | Wu et al. | |
| 2007/0020450 | A1* | 1/2007 | Kitamura et al. | 428/332 |
| 2007/0282051 | A1* | 12/2007 | Okano | 524/495 |

* cited by examiner

*Primary Examiner* — Harold Pyon
*Assistant Examiner* — Katie L Hammer
(74) *Attorney, Agent, or Firm* — Eugene O. Palazzo

(57) ABSTRACT

An intermediate transfer member that includes a crosslinked poly(ether ether ketone) polymer, an optional conductive component, an optional polymer, and an optional release additive.

17 Claims, 1 Drawing Sheet

CROSSLINKED POLY(ETHER ETHER KETONE) INTERMEDIATE TRANSFER MEMBERS

This disclosure is generally directed to an intermediate transfer member that includes a chemically crosslinked poly (ether ether ketone) (xPEEK) and an intermediate transfer member that contains a mixture of a crosslinked poly(ether ether ketone), an optional conductive filler component, an optional internal release additive, and an optional polymer binder.

BACKGROUND

There are known extruded or inflated intermediate transfer members that include certain thermoplastics that are insoluble or substantially insoluble in a number of known solvents, such as dimethyl sulfoxide, N-methyl-2-pyrrolidone, N,N-dimethylformamide, N,N-dimethylacetamide, and the like. Thus, the preparation of dispersions of thermoplastic polymers and conductive component intermediate transfer members is not considered advantageous, and may not be readily achievable.

Although a number of thermoplastic polymers might be selected for intermediate transfer members because of their low costs, they are, however, insoluble in most organic solvents, and therefore the desired solution casting methods via flow coating for the preparation of these members is usually not effectively achievable.

Also, there are known intermediate transfer members that include materials with characteristics that cause these members to become brittle resulting in inadequate acceptance of the developed image and subsequent partial transfer of developed xerographic images to a substrate like paper.

A further disadvantage relating to the preparation of an intermediate transfer member is that there is usually deposited a separate release layer on a metal substrate, and thereafter there is applied to the release layer the intermediate transfer member components, and where the release layer allows the components to be separated from the member by peeling, or by the use of mechanical devices. Subsequently, the intermediate transfer member components in the form of a film can be selected for xerographic imaging systems, or where the film can be deposited on a supporting substrate like a polymer layer. The use of a separate intermediate release layer adds to the cost and to the time of preparation of intermediate transfer members, and such a release layer can also modify a number of the intermediate transfer member characteristics.

It is known that carbon black can be used as the conductive particles in several intermediate transfer belts, however, carbon black can be difficult to disperse since there are very few polar groups on the surface thereof. Also, it can be difficult to generate carbon black based intermediate transfer belts with a consistent resistivity because the required loading is present on the vertical part of the percolation curve, and the working window for carbon black is very narrow. In addition, in humid environments, moisture will tend to deposit on the intermediate transfer member during idle and cause wrinkles, transfer failures and print defects.

There is a need for intermediate transfer members that substantially avoid or minimize the disadvantages of a number of known intermediate transfer members.

Further, there is a need for intermediate transfer members that can be prepared by solution casting flow coating processes, and where the films resulting have improved mechanical properties thereby extending their lifetimes.

Another need resides in the provision of intermediate transfer member materials where the polymers utilized are soluble or substantially soluble in a number of known solvents, such as organic solvents.

A further need resides in providing intermediate transfer member materials with acceptable resistivity, high modulus, and excellent break strength leading to transferred developed images with minimal resolution issues for extended time periods.

Also, there is a need for intermediate transfer member materials that possess self-release characteristics from a number of substrates that are selected when such members are prepared.

Moreover, there is a need for the flow coating preparation of intermediate transfer members that contain polymers that are soluble in various solvents, and which members possess improved stability with no or minimal degradation for extended time periods.

Additionally, there is a need for intermediate transfer members containing components that include novel soluble polymers that can be economically and efficiently manufactured.

Further, there is a need for intermediate transfer members with a combination of excellent resistivity, acceptable mechanical properties inclusive of extended time period toughness and stable substantially consistent characteristics.

These and other needs are achievable or can be achievable in embodiments with the intermediate transfer members and components thereof disclosed herein.

SUMMARY

There is disclosed an intermediate transfer member comprising a crosslinked poly(ether ether ketone); an intermediate transfer member comprising a crosslinked poly(ether ether ketone), a conductive component, a polysiloxane, and an optional internal release additive, wherein the crosslinked poly(ether ether ketone) is represented by the following formulas/structures, and wherein the crosslinking percentage subsequent to curing is from about 50 to about 99 percent as determined by Fourier Transform Infrared Spectroscopy (FTIR)

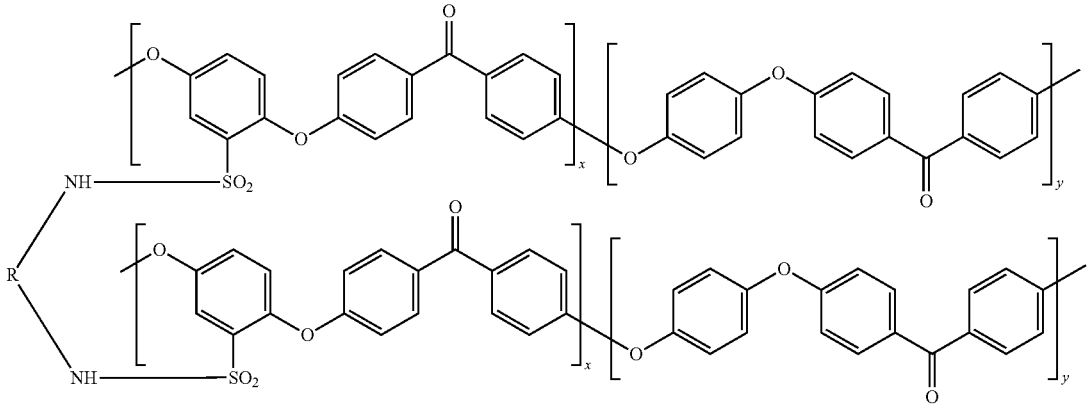

where x and y are the mole percent of the repeating units; x is from about 10 to about 95 mole percent; y is from about 5 to about 90 mole percent, and the sum of x plus y is equal to about 100 mole percent; and R is alkyl, aryl, or substituted derivatives thereof; and a crosslinked poly(ether ether ketone) generated from the reaction of a poly(ether ether ketone), a sulfur source, a carbonyldiimidazole, and a diamine.

FIGURES

The following Figures are provided to further illustrate the intermediate transfer members disclosed herein.

EMBODIMENTS

There is disclosed herein an intermediate transfer member comprising a crosslinked poly(ether ether ketone) (xPEEK) and mixtures or blends thereof that include suitable optional polymers, such as polysiloxanes and fluoropolymers, optional internal release additives, and optional conductive filler components.

The disclosed crosslinked poly(ether ether ketones) are soluble in organic solvents, such as dimethyl sulfoxide, N-methyl-2-pyrrolidone, N,N-dimethylformamide, N,N-dimethylacetamide, acetone and the like, enabling the effective dispersions thereof with conductive compounds, such as carbon blacks, and assists in enabling the self-release of intermediate transfer member films from substrates like a metal substrate, such as stainless steel, thereby avoiding the need for a separate costly release layer on the substrate.

Figure 1:
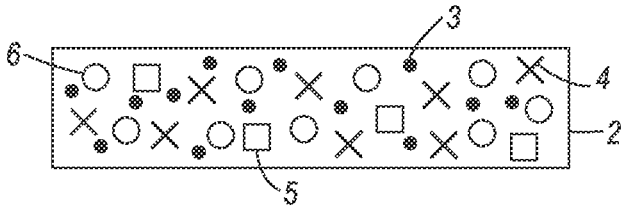
FIG. 1 illustrates an exemplary embodiment of a one-layer intermediate transfer member of the present disclosure.

In FIG. 1 there is illustrated an intermediate transfer member comprising a layer 2 of a mixture of a crosslinked poly (ether ether ketone) 3, an optional polymer binder 4, an optional release additive 5, and an optional conductive component 6.

Figure 2:
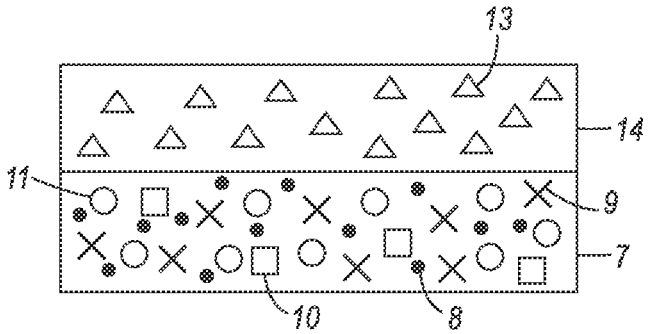
FIG. 2 illustrates an exemplary embodiment of a two-layer intermediate transfer member of the present disclosure.

In FIG. 2 there is illustrated a two-layer intermediate transfer member comprising a bottom layer 7 comprised of a crosslinked poly(ether ether ketone) 8, an optional polymer 9, an optional release additive 10, an optional conductive component 11, and an optional top or outer toner release layer 14, comprising film releasing components 13.

Figure 3:
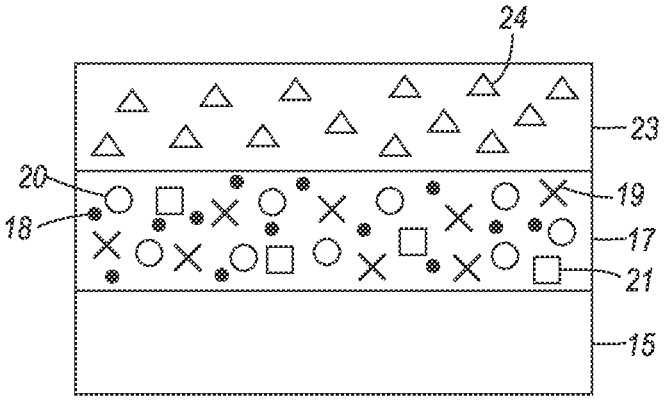
FIG. 3 illustrates an exemplary embodiment of a three-layer intermediate transfer member of the present disclosure.

In FIG. 3 there is illustrated a three layer intermediate transfer member comprising a supporting substrate 15, a layer 17 of a crosslinked poly(ether ether ketone) 18, an optional polysiloxane polymer 19, an optional release additive 21, an optional conductive component 20, and an optional release layer 23 comprising film releasing components 24.

The intermediate transfer members disclosed herein exhibit self-release characteristics, and where the use of an external release layer present on, for example, a stainless steel substrate is avoided; have excellent mechanical strength while permitting the rapid and complete transfer of from about 90 to about 100 percent, from about 95 to about 100 percent, and from about 95 to about 99 percent transfer of a xerographic developed image from a photoconductor in a xerographic imaging process and xerographic apparatus; possess a Young's modulus of, for example, from about 2,000 to about 6,500 Mega Pascals (MPa), from about 2,500 to about 6,500 MPa, from about 2,500 to about 3,500 MPa, or from about 2,800 to about 3,100 MPa; a break strength of from about 40 to about 100 MPa, from about 50 to about 90 MPa, from about 50 to about 75 MPa, or from about 50 to about 55 MPa; and a desirable resistivity as measured with a known High Resistivity Meter of, for example, from about $10^8$ to about $10^{13}$ ohm/square, from about $10^9$ to about $10^{13}$ ohm/square, from about $10^9$ to about $10^{12}$ ohm/square, from about $10^9$ to about $10^{10}$ ohm/square, and more specifically, from about $3\times10^9$ to about $4\times10^9$ ohm/square, or from about $3.1\times10^9$ to about $3.5\times10^9$ ohm/square.

The time period to obtain the self-release characteristics of the disclosed intermediate transfer layer films varies depending, for example, on the components present, and the amounts thereof selected for the crosslinked poly(ether ether ketone) polymer layer. Generally, however, the release time period is from about 1 to about 65 seconds, from about 1 to about 50 seconds, from about 1 to about 35 seconds, from about 1 to about 20 seconds, or from about 1 to about 5 seconds, and in some instances less than 1 second.

The intermediate transfer members of the present disclosure can be provided in any of a variety of configurations, such as a one-layer configuration, or in a multi-layer configuration including, for example, a top release layer. More specifically, the disclosed final intermediate transfer member may be in the form of an endless flexible belt, a web, a flexible drum or roller, a rigid roller or cylinder, a sheet, a drelt (a cross between a drum and a belt), a seamless belt that is with an absence of any seams or visible joints in the members, and the like.

Crosslinked Poly(ether ether ketones) (xPEEK)

Examples of the commercially available poly(ether ether ketone) (PEEK) polymers that can be crosslinked include VICTREX® PEEK 90G, 150G, 450G, 150FC30, 450FC30, 150FW30, 450FE20, WG101, WG102, ESD101, all available from VICTREX Manufacturing Limited, and which are crosslinked by the reaction of a formed sulfonated poly(ether ether ketone) (SPEEK), a catalyst like a carbonyldiimidazole and a diamine, and where the crosslinking percentage is, for example, from about 50 to about 99 percent, from about 55 to about 99 percent, from about 65 to about 95 percent, from about 75 to about 95 percent, or from about 70 to about 90 percent inclusive of all the crosslinking percentages therebetween these ranges.

Examples of the formulas/structures of the crosslinked poly(ether ether ketone) (xPEEK) polymers are as follow

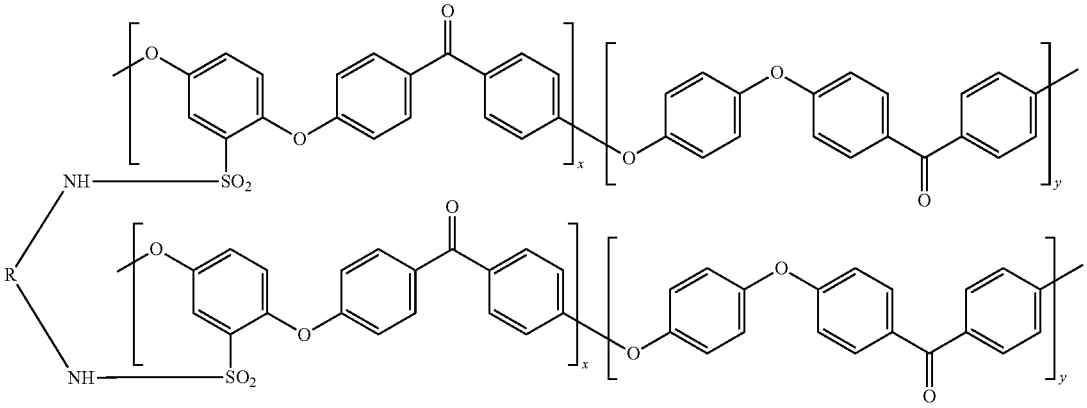

where x and y are the mole percent of the repeating units, x is from about 10 to about 95 mole percent, from about 30 to about 80 mole percent, or from 50 to about 75 mole percent; y is from about 5 to about 90 mole percent, from about 20 to about 70 mole percent, or from about 25 to about 50 mole percent, and the sum of x plus y is equal to about 100 mole percent; and R is an alkyl, aryl, substituted derivatives thereof, such as alkylaryl.

Alkyl includes those groups with from about 1 to about 25 carbon atoms, from 1 to about 18 carbon atoms, from about 1 to about 12 carbon atoms, or from about 1 to about 10 carbon atoms, such as methyl, ethyl, propyl, butyl, pentyl, hexyl, heptyl, octyl, nonyl, and the like. Aryl includes those groups with from about 6 to about 36 carbon atoms, from about 6 to about 24 carbon atoms, from about 6 to about 18 carbon atoms, or from about 6 to about 12 carbon atoms of, for example, phenyl, napthyl, anthryl and substituted derivatives thereof.

Examples of specific crosslinked poly(ether ether ketones) suitable for incorporation into the disclosed intermediate transfer members are represented, for example, by at least one of the following formulas/structures

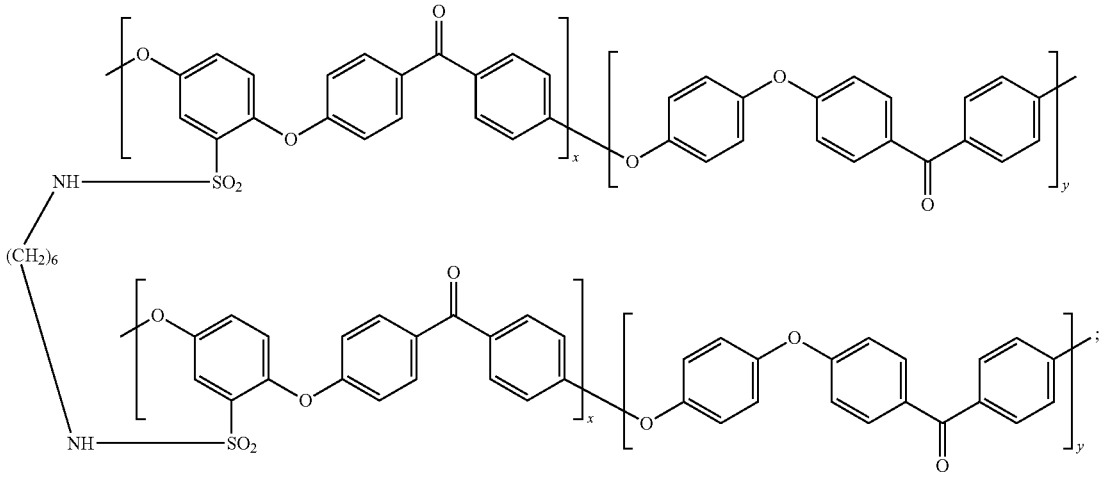

-continued
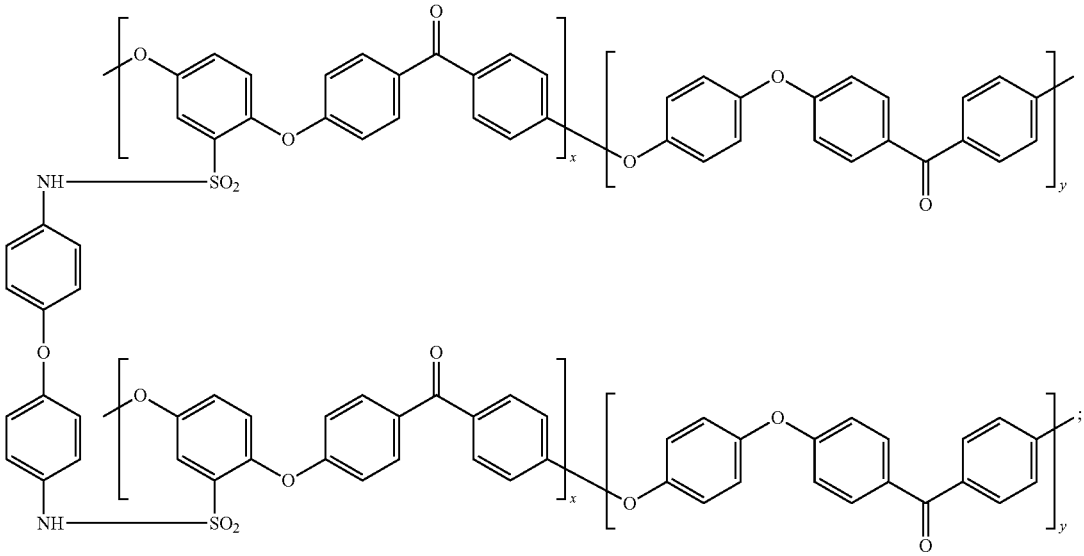
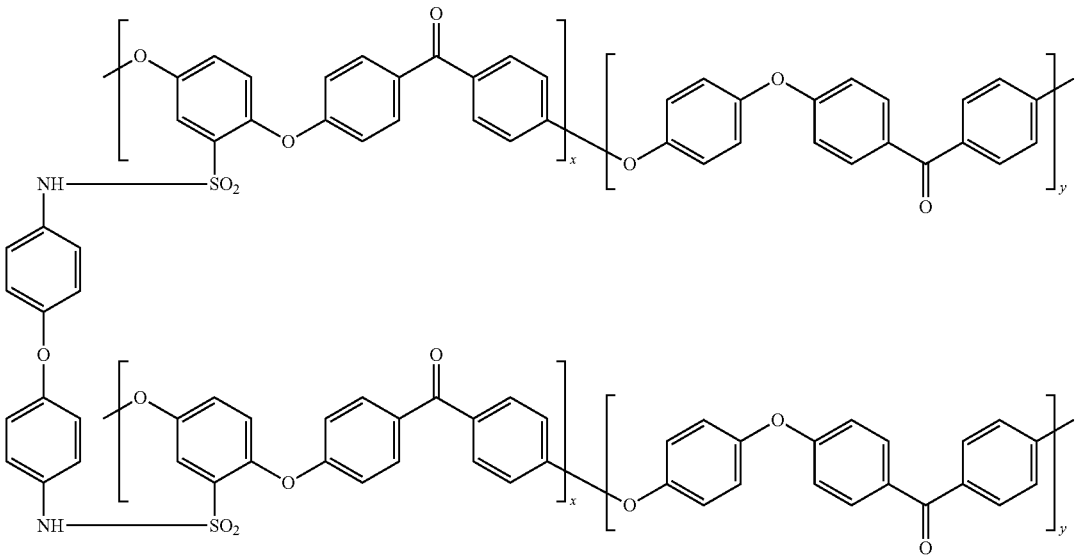
and

-continued

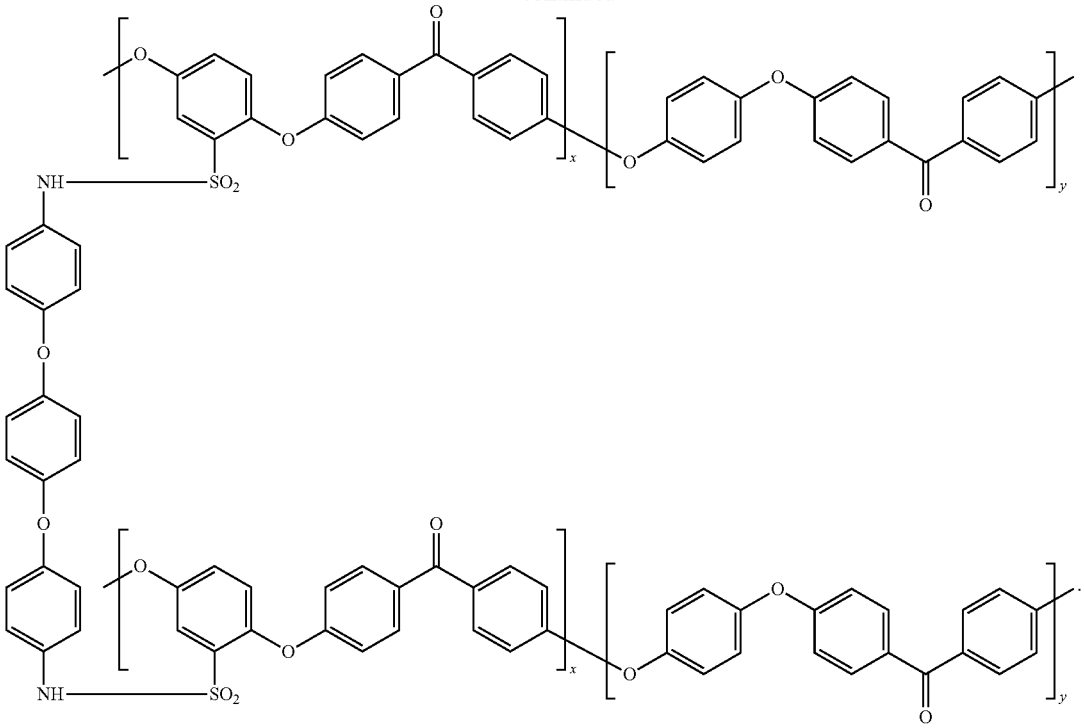

The number average molecular weight of the novel crosslinked poly(ether ether ketone) is, for example, from about 40,000 to about 150,000, or from about 60,000 to about 100,000, and the weight average molecular weight of the crosslinked poly(ether ether ketone) is, for example, from about 80,000 to about 250,000, or from about 120,000 to about 180,000, each as determined by Gel Permeation Chromatography (GPC).

The disclosed crosslinked poly(ether ether ketones) are present in the intermediate transfer members in various effective amounts, such as for example about 100 weight percent, from about 55 to about 99 weight percent, from about 60 to about 97 percent by weight, or from about 60 to about 75 percent by weight of the solids and where the total solids equals about 100 percent.

The sulfonated poly(ether ether ketone) (SPEEK) reactant can be represented by the following formulas/structures

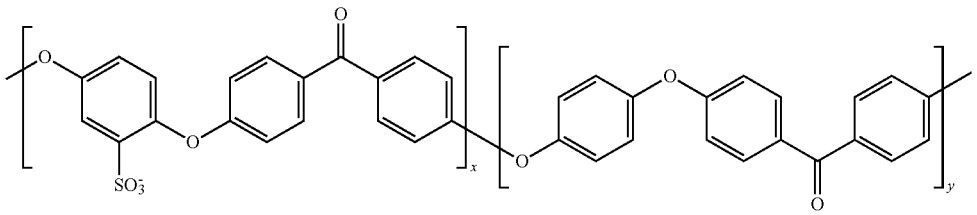

where x and y are the mole percent of the repeating units, x is from about 10 to about 95 mole percent, from about 30 to about 80 mole percent, or from about 50 to about 75 mole percent; y is from about 5 to about 90 mole percent, from about 20 to about 70 mole percent, or from about 25 to about 50 mole percent, and the sum of x plus y is equal to about 100 mole percent. Subsequently, the above obtained sulfonated poly(ether ether ketone) was crosslinked with a carbonyldiimidazole, such as 1,1'-thiocarbonyldiimidazole, 1,1'-oxalyldiimidazole, 1,1-carbonyldiimidazole (CU), or mixtures thereof, and the like, which primarily function as catalysts, and a diamine. Thereafter, the resulting crosslinked (xPEEK) can be formulated into an intermediate transfer member by, for example, solution casting, and where the resulting member exhibits the characteristics disclosed herein.

Examples of solvents selected for the formation of the disclosed dispersions of the coating mixtures containing the soluble crosslinked poly(ether ether ketones), which solvents can be selected in an amount of, for example, from about 50 to about 90 weight percent, from about 60 to about 85 weight percent, or from about 70 to about 80 weight percent of the total mixture components include alkylene halides, such as methylene chloride, tetrahydrofuran, toluene, halobenzenes, such as monochlorobenzene, N-methyl-2-pyrrolidone, N,N-dimethylformamide, N,N-dimethylacetamide, methyl ethyl ketone, dimethylsulfoxide, methyl isobutyl ketone, formamide, acetone, ethyl acetate, cyclohexanone, acetanilide, mixtures thereof, and the like. Diluents can be mixed with the solvents selected for the intermediate transfer member mixtures. Examples of diluents added to the solvents in amounts of from about 1 to about 25 weight percent, and from 1 to about 10 weight percent based on the weight of the solvent and the diluent are known diluents like aromatic hydrocarbons, ethyl acetate, cyclohexanone and acetanilide.

More specifically, the crosslinked (xPEEK) can be prepared in accordance with the following reactions wherein x, y, and R are as illustrated herein ether ketone), and then allowing the reaction mixture to cool to room temperature of, for example, from about 23° C. to about 27° C., there is formed a solution of the sulfonated poly(ether ether ketone), which can be precipitated from water, isolated by filtration, and thermally dried.

1.

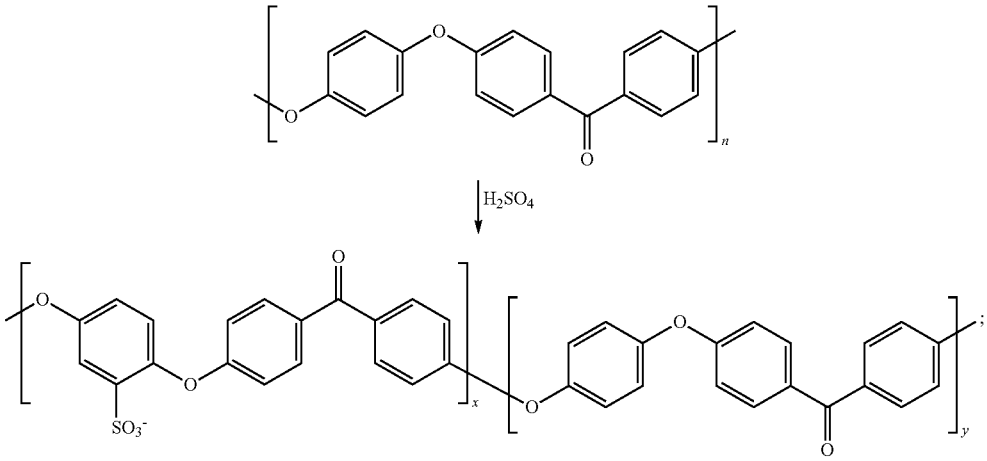

2.

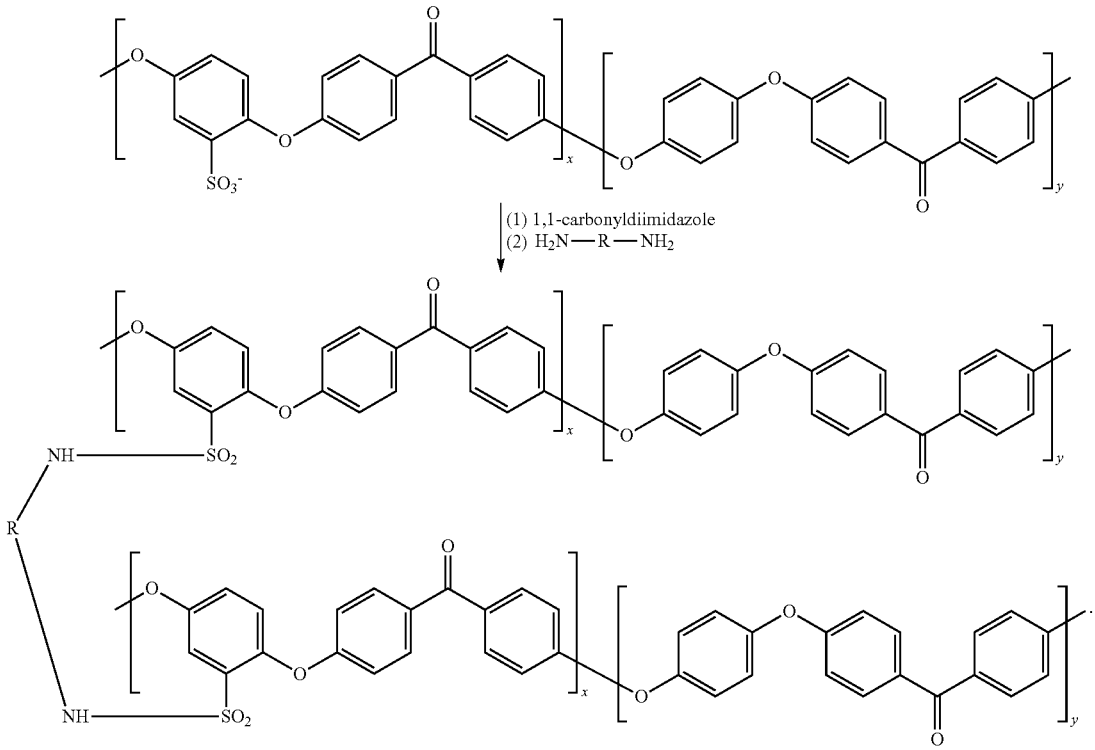

In 1. above, the reaction comprises the sulfonation of PEEK resulting in a sulfonated PEEK (SPEEK), which is soluble in common organic solvents disclosed herein. With heating at elevated temperatures of, for example, from about 75° C. to about 155° C., or from about 100° C. to about 140° C. of a mixture of a source of sulfur, like concentrated sulfuric acid, and a commercially available VICTREX® poly(ether As represented by 2. above, there is accomplished the crosslinking of the sulfonated PEEK with a diamine as represented, for example, by $H_2N—R—NH_2$, where R is an alkyl, aryl, alkylaryl group with the carbon chain numbers as illustrated herein, and where a catalyst, such as 1,1-carbonyldiimidazole, is used to accelerate the crosslinking reaction.

In one embodiment, poly(ether ether ketone) (PEEK) pellets of the formulas/structures disclosed herein can be added to a source of sulfur, such as concentrated bulk sulfuric acid, with the weight ratio of the PEEK to the source of sulfur being, for example, from about ½ to about 1/10, and subsequently, the resulting mixture can be vigorously stirred for a time period of, for example, from about 2 to about 18 hours, or from about 7 to about 12 hours at, for example, a temperature of from about 40° C. to about 80° C., or from about 55° C. to about 70° C. During heating, sulfonate groups are attached to the benzene ring between the two ether bonds of the PEEK polymer resulting in a dark brown solution. The sulfonated poly(ether ether ketone) (SPEEK) product can be isolated by precipitation into, for example, cool water, and then can be washed several times to remove residual acids in the precipitate. The SPEEK polymer was subsequently dried, and analyzed for its chemical structures by NMR and for molecular weights by GPC.

Sulfur Sources

In addition to sulfuric acid, a number of known sulfur sources can be selected for the sulfonation of the poly(ether ether ketone), such as sulfur trioxide, sulfamic acid, chlorosulfonic acid, oleum, and the like.

The sulfuric acid can be of a number of different concentrations, such as from about 10 to about 98 percent, from about 20 to about 80 percent, from about 30 to about 65 percent, and other known concentrations, and fuming sulfuric acid can also be selected as a reactant. Usually the sulfuric acid is used in excess such as a PEEK/sulfuric acid ratio of from about 3/1 to about 1/20, or from about 1/1 to about 1/10.

The resulting sulfonated PEEK (SPEEK) can be represented by the following formulas/structures

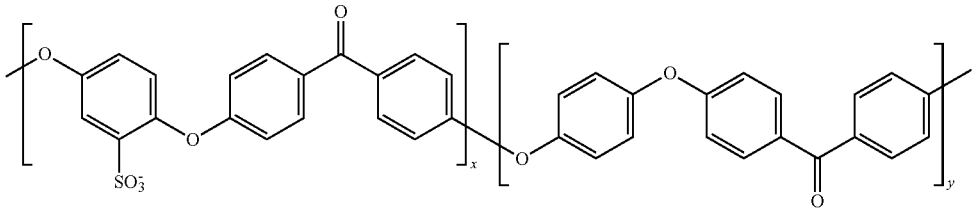

where x and y are the mole percent of the repeating units; x is from about 10 to about 95 mole percent, from about 30 to about 80 mole percent, or from about 50 to about 75 mole percent; y is from about 5 to about 90 mole percent, from about 20 to about 70 mole percent, or from about 25 to about 50 mole percent, and the sum of x plus y is equal to about 100 mole percent.

Diamines

Diamine examples that can be used to crosslink the sulfonated PEEK include 1,6-hexane diamine, 1,4-butane diamine, 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenyl-sulfone, 4,4'-diamino-p-terphenyl, 1,3-bis-(gamma-aminopropyl)-tetramethyl-disiloxane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluoro-biphenyl, 4,4'-diamino-2,2',3,3',5,5',6,6'-octafluorodiphenyl ether, bis[4-(3-aminophenoxy)-phenyl] sulfide, bis[4-(3-aminophenoxy)phenyl]sulfone, bis[4-(3-aminophenoxy)phenyl]ketone, 4,4'-bis(3-aminophenoxy) biphenyl, 2,2-bis[4-(3-aminophenoxy)phenyl]-propane, 2,2-bis[4-(3-aminophenoxy)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl)ethane, 2,2-di(p-aminophenyl)propane, 2,2-di(p-aminophenyl)-1,1,1,3,3,3-hexafluoropropane, and the like, and mixtures thereof.

The sulfonated PEEK (SPEEK) can be dissolved in solvents, such as dimethyl sulfoxide (DMSO), N-methyl-2-pyrrolidone (NMP), N,N-dimethylformamide, N,N-dimethylacetamide (DMAc), dimethyl sulfoxide, N-methyl-2-pyrrolidone, and the like, to prepare a polymer solution of from about 10 to about 20 weight percent solids. The catalyst, such as 1,1-carbonyldiimidazole (CDI) of from about 0.1 to about 1 mole equivalent with respect to the sulfonate groups of the SPEEK, can then be added to the polymer solution. N-sulfonylimidazole groups of the SPEEK are prepared after from about 2 to about 5 hours when the formation of carbon dioxide gas ceases. Subsequently, conversion of the N-sulfonylimidazoles to sulfonamides is then carried out by adding a diamine, such as those illustrated herein like 1,6-hexane diamine or 4,4'-diaminodiphenyl ether, into the mixture with ratio of, for example, from about 0.3 to about 0.8 mole equivalent per CDI. After further stirring for a period of from about 1 to about 4 hours, the mixture is then retained at a temperature of from about 40° C. to about 70° C. for a period of from about 6 to about 24 hours.

While not desiring to be limited by theory, it is believed that the crosslinking percentage of the crosslinked poly(ether ether ketone) (xPEEK) polymer is, for example, from about 55 to about 99 percent, from about 77 to about 97 percent, from about 80 to about 95 percent, or from about 70 to about 90 percent, as determined by known methods, such as determined with Fourier Transform Infrared Spectroscopy (FTIR).

Excellent crosslinked poly(ether ether ketone) polymer dispersions, especially dispersions containing mixtures of conductive materials like carbon black refers, for example, to the crosslinked poly(ether ether ketone) being soluble in a suitable solvent of, for example, the solvents as illustrated herein, and where the solubility is, for example, from about 90 to about 100 percent, from about 90 to about 98 percent, or from about 95 to about 97 percent.

Optional Polymers

The disclosed intermediate transfer member mixture can also comprise optional suitable known polymers like a polysiloxane polymer functioning primarily as a leveling agent. Examples of polysiloxane polymers selected for the intermediate transfer member mixture disclosed herein include known suitable polysiloxanes, such as a polyether modified polydimethylsiloxane, commercially available from BYK Chemical as BYK® 333, BYK® 330 (about 51 weight percent in methoxypropylacetate), BYK® 344 (about 52.3 weight percent in xylene/isobutanol, ratio of 80/20), BYK®-SILCLEAN 3710 and BYK® 3720 (about 25 weight percent in methoxypropanol); a polyester modified polydimethylsiloxane, commercially available from BYK Chemical as BYK® 310 (about 25 weight percent in xylene) and BYK® 370 (about 25 weight percent in xylene/alkylbenzenes/cyclohexanone/monophenylglycol, ratio of 75/11/7/7); a polyacrylate modified polydimethylsiloxane, commercially available from BYK Chemical as BYK®-SILCLEAN 3700 (about 25 weight percent in methoxypropylacetate); a polyester polyether modified polydimethylsiloxane, commercially available from BYK Chemical as BYK® 375 (about 25 weight percent in di-propylene glycol monomethyl ether), and mixtures thereof.

The polysiloxane polymer or copolymers thereof can be present in the intermediate transfer member mixture in various effective amounts, such as from about 0.01 to about 1 weight percent, from about 0.05 to about 1 weight percent, from about 0.05 to about 0.5 weight percent, or from about 0.1 to about 0.3 weight percent based on the weight percent of the solid components present in the mixture, such as the components of the crosslinked poly(ether ether ketone), the optional polysiloxane polymer, the optional internal release additive, and when present the conductive component.

Optional Release Additives

A number of known optional internal release additives present in various effective amounts, such as in an amount of, for example, from about 0.05 to about 10 weight percent, from about 0.01 to about 10 weight percent, from about 0.1 to about 5 weight percent, from about 0.2 to about 2 weight percent, from about 0.1 to about 3.5 weight percent, or from about 0.1 to about 2.5 weight percent, and where the weight percent is based on the total solids, can be included in the disclosed intermediate transfer member mixture to further assist in the release of the member from metal substrates. Examples of internal release additives incorporated into the crosslinked poly(ether ether ketones) or dispersions thereof include acid functionalized fluoro components of carboxylic acid functionalized fluoro components, such as octafluoroadipic acid, dodecafluorosuberic acid, hexadecafluorosebacic acid, heptadecafluoro-n-nonanoic acid, nonadecafluorodecanoic acid, nonafluorovaleric acid, pentadecafluorooctanoic acid, undecafluorohexanoic acid, and mixtures thereof; or phosphate esters of alkylphenoxy polyethoxyethanols, such as commercially available STEPFAC® like STEPFAC® 8171, and the like.

Optional Fillers

Optionally, the intermediate transfer member may contain one or more component fillers to, for example, alter and adjust the conductivity of the intermediate transfer member. Where the intermediate transfer member is a one layer structure, the conductive filler can be included in the crosslinked poly(ether ether ketone) layer disclosed herein. However, when the intermediate transfer member is a multi-layer structure, the conductive filler can be included in one or more layers of the member, such as in the supporting substrate, the crosslinked poly(ether ether ketone), or the containing mixture thereof layer, and in both the supporting substrate and the crosslinked poly(ether ether ketones) layer or mixtures thereof.

Various effective suitable fillers can be included in the disclosed intermediate transfer members that provide the desired results. For example, suitable fillers include carbon blacks, metal oxides, polyanilines, other known suitable fillers, and mixtures of fillers.

Examples of carbon black fillers that can be selected for the intermediate transfer members illustrated herein include special black 4 (B.E.T. surface area=180 $m^2/g$, DBP absorption=1.8 ml/g, primary particle diameter=25 nanometers) available from Evonik-Degussa, special black 5 (B.E.T. surface area=240 $m^2/g$, DBP absorption=1.41 ml/g, primary particle diameter=20 nanometers), color black FW1 (B.E.T. surface area=320 $m^2/g$, DBP absorption=2.89 ml/g, primary particle diameter=13 nanometers), color black FW2 (B.E.T. surface area=460 $m^2/g$, DBP absorption=4.82 ml/g, primary particle diameter=13 nanometers), color black FW200 (B.E.T. surface area=460 $m^2/g$, DBP absorption=4.6 ml/g, primary particle diameter=13 nanometers), all available from Evonik-Degussa; VULCAN® carbon blacks, REGAL® carbon blacks, MONARCH® carbon blacks, and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), VULCAN® XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); special carbon blacks available from Evonik Incorporated; and Channel carbon blacks available from Evonik-Degussa. Other known suitable carbon blacks not specifically disclosed herein may be selected as the filler or conductive component for the intermediate transfer members disclosed herein.

Examples of polyaniline fillers that can be selected for incorporation into the disclosed intermediate transfer member compositions are PANIPOL™ F, commercially available from Panipol Oy, Finland, and known lignosulfonic acid grafted polyanilines. These polyanilines usually have a relatively small particle size diameter of, for example, from about 0.5 to about 5 microns; from about 1.1 to about 2.3 microns, or from about 1.5 to about 1.9 microns.

Metal oxide fillers that can be selected for the disclosed intermediate transfer member composition include, for example, tin oxide, antimony doped tin oxide, indium oxide, indium tin oxide, zinc oxide, and titanium oxide, and the like.

When present, the filler can be selected in an amount of, for example, from about 1 to about 60 weight percent, from about 3 to about 40 weight percent, from about 4 to about 30 weight percent, from about 10 to about 30 percent, from about 3 to about 30 weight percent, from about 5 to about 30 weight percent, from about 8 to about 25 weight percent, or from about 13 to about 20 weight percent of the weight percent of the total solids of the synthesized crosslinked poly(ether ether ketone), and which poly(ether ether ketone) is present in an amount of from about 60 to about 97 weight percent, or from about 70 to about 90 weight percent based on the ingredients present. The weight ratio of the poly(ether ether ketone) to the conductive component, such as carbon black, is, for example, from about 95/5 to about 60/40 or from about 90/10 to about 80/20.

Adhesive Layer

Adhesive layer components usually situated between the supporting substrate, and the crosslinked poly(ether ether ketone) containing layer thereover include, for example, a number of resins or polymers of epoxy, urethane, silicone, polyester, and the like. Generally, the adhesive layer is a solventless layer, that is materials that are liquid at room temperature (about 25° C.), and are able to crosslink to an elastic, or rigid film to adhere at least two materials together. Specific adhesive layer components include 100 percent solids adhesives including polyurethane adhesives obtained from Lord Corporation, Erie, Pa., such as TYCEL® 7924 (viscosity from about 1,400 to about 2,000 cps), TYCEL® 7975 (viscosity from about 1,200 to about 1,600 cps), and TYCEL® 7276. The viscosity range of the adhesives is, for example, from about 1,200 to about 2,000 cps. The solventless adhesives can be activated with either heat, room temperature curing, moisture curing, ultraviolet radiation, infrared radiation, electron beam curing, or any other known technique. The thickness of the adhesive layer is usually less than about 100 nanometers, and more specifically, for example, from about 1 to about 100 nanometers, from about 5 to about 75 nanometers, or from about 50 to about 100 nanometers.

Optional Release Layer

When desired, an optional release layer can be included over the crosslinked poly(ether ether ketone) containing layer illustrated herein. The release layer may be included to assist in providing additional toner cleaning, and further developed image transfer efficiency from a photoconductor to the intermediate transfer member.

The release layer can have any desired and suitable thickness. For example, the release layer can have a thickness of from about 1 to about 100 microns, from about 10 to about 75 microns, or from about 20 to about 50 microns.

The optional release layer can comprise TEFLON®-like materials including fluorinated ethylene propylene copolymer (FEP), polytetrafluoroethylene (PTFE), polyfluoroalkoxy polytetrafluoroethylene (PFA TEFLON®), and other TEFLON®-like materials; silicone materials, such as fluorosilicones and silicone rubbers, such as Silicone Rubber 552, available from Sampson Coatings, Richmond, Va. (polydimethyl siloxane/dibutyl tin diacetate, 0.45 gram DBTDA per 100 grams polydimethyl siloxane rubber mixture with a molecular weight $M_w$ of approximately 3,500); and fluoroelastomers, such as those sold as VITON®, such as copolymers and terpolymers of vinylidenefluoride, hexafluoropropylene, and tetrafluoroethylene, which are known commercially under various designations as VITON A®, VITON E®, VITON E60C®, VITON E45®, VITON E430®, VITON B910®, VITON GH®, VITON B50®, and VITON GF®. The VITON® designation is a trademark of E.I. DuPont de Nemours, Inc. Two known fluoroelastomers are comprised of (1) a class of copolymers of vinylidenefluoride, hexafluoropropylene, and tetrafluoroethylene, known commercially as VITON A®; (2) a class of terpolymers of vinylidenefluoride, hexafluoropropylene, and tetrafluoroethylene, known commercially as VITON B®; and (3) a class of tetrapolymers of vinylidenefluoride, hexafluoropropylene, tetrafluoroethylene, and a cure site monomer, such as VITON GF®, having 35 mole percent of vinylidenefluoride, 34 mole percent of hexafluoropropylene, and 29 mole percent of tetrafluoroethylene with 2 percent cure site monomer. The cure site monomers can be those available from E.I. DuPont de Nemours, Inc. such as 4-bromoperfluorobutene-1,1,1-dihydro-4-bromoperfluorobutene-1,3-bromoperfluoropropene-1,1,1-dihydro-3-bromoperfluoropropene-1, or commercially available cure site monomers.

Intermediate Transfer Member Formation

The crosslinked poly(ether ether ketone) or mixtures thereof illustrated herein comprising, for example, a solution of the generated crosslinked poly(ether ether ketone), a conductive filler component, an optional polymer, and an optional internal release additive can be formulated into an intermediate transfer member by any suitable method, inclusive of known solution casting processes. For example, with known milling processes, the crosslinked poly(ether ether ketone) or uniform dispersions of the crosslinked poly(ether ether ketone) intermediate transfer member mixtures can be obtained. The dispersion obtained can then be coated on a metal substrate, such as stainless steel, using known coating methods such as flow coating or draw bar coating. The resulting individual film, films or belts can be cured and dried at high temperatures, such as by heating and drying the films or belts by heating at from about 60° C. to about 250° C., from about 90° C. to about 220° C., or from about 120° C. to about 190° C., for a suitable time period of, for example, from about 30 to 180 minutes, from about 45 to about 120 minutes, or from about 35 to about 90 minutes, and more specifically, where curing is accomplished by heating the intermediate transfer member mixture to from about 80° C. to about 250° C., or from about 140° C. to about 175° C., while remaining on the substrate. After drying and cooling to room temperature, about 23° C. to about 25° C., the films or belts self-release from the steel substrates, that is the film or belt releases without any external assistance. The resultant intermediate transfer film or belt product can have a thickness of, for example, from about 15 to about 150 microns, from about 20 to about 100 microns, from about 50 to about 65 microns, and more specifically, about 60 microns.

Solution casting processes for the preparation of the disclosed intermediate transfer members can also utilize centrifugal forces by adding the crosslinked poly(ether ether ketone)/carbon black dispersion with optional polymers and optional release additives inside a metal spinning mandrel, and where the centrifugal force spreads the dispersion into intermediate transfer films.

As substrates selected for the deposition of the crosslinked poly(ether ether ketone) or the mixtures disclosed herein, there can be selected stainless steel, aluminum, nickel, copper, and their alloys, glass, and other conventional typical known materials.

Optional Supporting Substrates

An optional supporting substrate can be included in the intermediate transfer member, such as beneath the generated crosslinked poly(ether ether ketone) containing layer. An optional supporting substrate can be included to provide increased rigidity or strength to the intermediate transfer member.

Examples of the intermediate transfer member supporting substrates are polyimides inclusive of known low temperature, and rapidly cured polyimide polymers, such as VTEC™ PI 1388, 080-051, 851, 302, 203, 201, and PETI-5, all available from Richard Blaine International, Incorporated, Reading, Pa., polyamideimides, polyetherimides, and the like. The thermosetting polyimides can be cured at temperatures of from about 180° C. to about 260° C. over a short period of time, such as from about 10 to about 120 minutes, or from about 20 to about 60 minutes, and generally have a number average molecular weight of from about 5,000 to about 500,000 or from about 10,000 to about 100,000, and a weight average molecular weight of from about 50,000 to about 5,000,000 or from about 100,000 to about 1,000,000. Also, for the supporting substrate there can be selected thermosetting polyimides that can be cured at temperatures of above 300° C., such as PYRE M.L.® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100, commercially available from FUJIFILM Electronic Materials U.S.A., Inc., North Kingstown, R.I.; and KAPTON® HN, VN and FN, all commercially available from E.I. DuPont, Wilmington, Del.

Examples of polyamideimides that can be selected as supporting substrates for the intermediate transfer members disclosed herein are VYLOMAX® HR-11NN (15 weight percent solution in N-methylpyrrolidone, $T_g$=300° C., and $M_w$=45,000), HR-12N2 (30 weight percent solution in N-methylpyrrolidone/xylene/methyl ethyl ketone=50/35/15, $T_g$=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and $M_w$=100,000), all commercially available from Toyobo Company of Japan, and TORLON® AI-10 ($T_g$=272° C.), commercially available from Solvay Advanced Polymers, LLC, Alpharetta, Ga.

Examples of specific polyetherimide supporting substrates that can be selected for the intermediate transfer members disclosed herein are ULTEM® 1000 ($T_g$=210° C.), 1010 ($T_g$=217° C.), 1100 ($T_g$=217° C.), 1285, 2100 ($T_g$=217° C.), 2200 ($T_g$=217° C.), 2210 ($T_g$=217° C.), 2212 ($T_g$=217° C.), 2300 ($T_g$=217° C.), 2310 ($T_g$=217° C.), 2312 ($T_g$=217° C.), 2313 ($T_g$=217° C.), 2400 ($T_g$=217° C.), 2410 ($T_g$=217° C.), 3451 ($T_g$=217° C.), 3452 ($T_g$=217° C.), 4000 ($T_g$=217° C.), 4001 ($T_g$=217° C.), 4002 ($T_g$=217° C.), 4211 ($T_g$=217° C.), 8015, 9011 ($T_g$=217° C.), 9075, and 9076, all commercially available from Sabic Innovative Plastics.

Once formed, the supporting substrate can have any desired and suitable thickness. For example, the supporting substrate can have a thickness of from about 10 to about 300 microns, such as from about 50 to about 150 microns, from about 75 to about 125 microns, or about 80 microns.

The intermediate transfer members illustrated herein can be utilized for a number of printing and copying systems, inclusive of xerographic printing systems that contain photoconductors. For example, the disclosed intermediate transfer member can be incorporated into a multi-imaging xerographic machine where each developed toner image to be transferred is formed on a photoconductor at an image forming station, and where each of these images is then developed with a toner at a developing station, and transferred to the intermediate transfer member. Also, the images may be formed on a photoconductor and developed sequentially, and then transferred to the intermediate transfer member. In an alternative method, each image may be formed on the photoconductor, developed, and then transferred in registration to the intermediate transfer member. The multi-image stage system in embodiments can be a color copying system, wherein each color of an image being copied is formed on a photoconductor, developed with toners, and then transferred to the intermediate transfer member.

After the toner latent image has been transferred from the photoconductor to the intermediate transfer member, the intermediate transfer member may be contacted under heat and pressure with an image receiving substrate such as paper. The toner image on the intermediate transfer member is then transferred and fixed by heat in image configuration to a document, such as paper.

Specific embodiments will now be described in detail. These examples are intended to be illustrative, and are not limited to the materials, conditions, or process parameters set forth in these embodiments. All parts are percentages by weight of total solids of all the components unless otherwise indicated.

EXAMPLE I

Synthesis of Sulfonated Poly(Ether Ether Ketone)

Experimentally, 50 grams of the poly(ether ether ketone) VICTREX® 150G pellets were added to 300 grams of bulk sulfuric acid, followed by vigorously stirring for 24 hours at 60° C. During this time, the sulfonate groups became attached to the benzene ring between the two ether bonds of the poly (ether ether ketone) polymer (PEEK) as determined by NMR analysis, and a dark brown solution was obtained. The resulting sulfonated poly(ether ether ketone) (SPEEK) was obtained by the dropping precipitation of the obtained dark brown solution into cool water, and washing several times with distilled water to remove residual acids present in the precipitation. After drying in a vacuum oven at 60° C. for 24 hours, and cooling to room temperature, about 25° C., there was obtained a synthetic SPEEK polymer as represented by the following formulas/structures, wherein x is equal to 66 mole percent and y is equal to 34 mole percent. As determined by GPC, the number average molecular weight of the SPEEK was about 85,000, and the weight average molecular weight of the SPEEK was about 161,000.

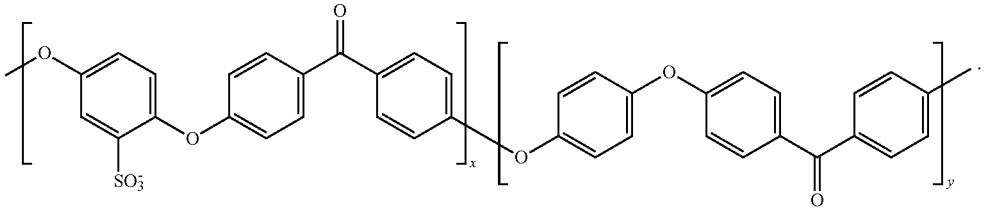

Non-crosslinked PEEK

EXAMPLE II

Synthesis of Crosslinked Poly(Ether Ether Ketone)

The above prepared synthetic SPEEK of Example I was dissolved in N-methyl-2-pyrrolidone (NMP) at about 10 percent solids, and 1,1-carbonyldiimidazole (CDI) of 0.5 mole equivalents with respect to the sulfonate groups present on the SPEEK, was added to the stirred solution, where the imidazole-activation of the sulfonate groups of the SPEEK took place.

N-sulfonylimidazole groups of the SPEEK resulted after 3 hours when the formation of carbon dioxide gas stopped. Subsequently, conversion of the N-sulfonylimidazoles to sulfonamides was initiated by adding 1,6-hexane diamine (HDA), an aliphatic crosslinker into the above resulting mixture with ratio of 0.5 mole equivalent per CDI. After further stirring for 1 hour, the resulting mixture was maintained at 60° C. for 18 hours. There resulted after filtering through a 20 micron Nylon cloth, a crosslinked poly(ether ether ketone) (xPEEK)/NMP solution followed by filtering to separate the solid xPEEK. As determined by GPC, the number average molecular weight of the xPEEK was about 90,000, and the weight average molecular weight of the xPEEK was about 170,000.

EXAMPLE III

Preparation of Intermediate Transfer Member By Solution Casting

Intermediate transfer member coating dispersions or solutions were separately prepared by ball milling the above prepared Example I sulfonated poly(ether ether ketone) (SPEEK), and the Example II crosslinked poly(ether ether ketone) (xPEEK) solutions (each solution in about 10 weight percent in NMP) with carbon black (Special black 4), respectively. To the resulting two separate dispersions were then added 0.05 weight percent of the polysiloxane BYK® 333 (surface leveling agent) and 1 weight percent of STEPFAC® 8171 (internal release additive), and the final coating dispersions were filtered through a 20 micron Nylon cloth. The weight ratio of sulfonated poly(ether ether ketone)/Special Black 4/BYK® 333/STEPFAC® 8171 [Example III(a)] and the weight ration of the crosslinked poly(ether ether ketone)/Special Black 4/BYK® 333/STEPFAC® 8171 [Example III (b)] was 87.95/11/0.05/1, respectively, wherein the crosslinking percentage [Example III(b)] subsequent to curing was about 90 percent as determined by Fourier Transform Infrared Spectroscopy (FTIR).

The above prepared dispersions were coated on a stainless steel sheet substrate, and dried at 120° C. for 20 minutes, and then 200° C. for additional 40 minutes. The resulting intermediate transfer members were about 60 microns in thickness and the member of [Example III(b)] immediately, about one second, self-released from the stainless steel substrate without the need to apply an additional release layer on the stainless steel.

The above prepared intermediate transfer members were then tested for surface resistivity and mechanical properties. The results are shown in the following Table 1.

EXAMPLE IV

An intermediate transfer member is prepared by repeating the processes of Example III except that there is selected in place of the N-methyl-2-pyrrolidone solvent, dimethyl sulfoxide, acetone, N,N-dimethylformamide, or N,N-dimethylacetamide, and in place of 1,6-hexane diamine, 4,4'-diaminodiphenylmethane, 3,3'-diaminodiphenylmethane, 1,3-diaminobenzene, or 4,4'-diaminodiphenyl ether, and substantially similar products and similar results are believed to be obtainable.

MEASUREMENTS

The resistivity of the above Example III intermediate transfer member films were measured using a High Resistivity Meter.

The above intermediate transfer members of Example III were also measured for Young's Modulus following the known ASTM D882-97 process. A sample (0.5 inch×12 inch) of each of the intermediate transfer members were placed in the Instron Tensile Tester measurement apparatus, and then the sample was elongated at a constant pull rate until breaking. During this time, there was recorded the resulting load versus the sample elongation. The Young's Modulus was calculated by taking any point tangential to the initial linear portion of the recorded curve results and dividing the tensile stress by the corresponding strain. The tensile stress was calculated by the load divided by the average cross sectional area of each of the test samples. Break strength, when the sample broke, was measured by the known tensile stress test.

The data obtained per the above measurements is shown in Table 1.

TABLE 1

| | Surface Resistivity (Ohm/Sq) | Young's Modulus (MPa) | Break Strength (MPa) |
|---|---|---|---|
| Example III(b), xPEEK, crosslinked | $3.1 \times 10^9$ | 2,900 | 55 |
| Example III(a), SPEEK, non crosslinked | $4.5 \times 10^9$ | 1,900 | 41 |

The above prepared crosslinked xPEEK intermediate transfer members possessed improved mechanical properties as compared with the controlled non crosslinked SPEEK intermediate transfer member as evidenced by about 50 percent higher modulus and 35 percent higher break strength. It is believed that an aromatic diamine crosslinker would further improve the mechanical properties of the resulting xPEEK intermediate transfer member.

Subsequent to the about one second release from the stainless steel substrate without the need to apply an additional release layer on the stainless steel, there can be coated on a supporting substrate the xSPEEK product of Example III.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer member comprising a crosslinked poly(ether ketone) represented by the following formulas/structures

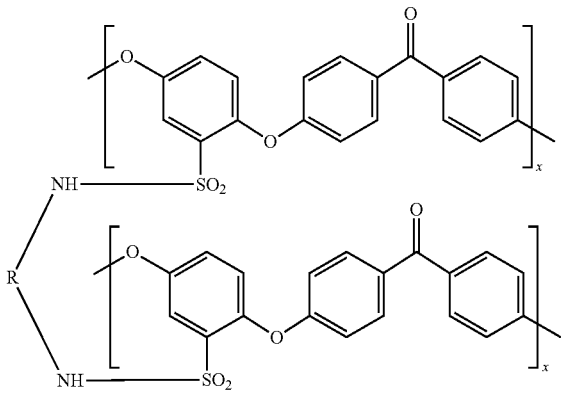

where x and y are the mole percent of the repeating units; x is from about 10 to about 95 mole percent; y is from about 5 to about 90 mole percent, and the sum of x plus y is equal to about 100 mole percent; and R is alkyl, aryl, or substituted derivatives thereof.

2. An intermediate transfer member in accordance with claim 1 with a crosslinking percentage subsequent to curing being from about 55 to about 99 percent as determined by Fourier Transform Infrared Spectroscopy (FTIR), and wherein said member possesses a Young's Modulus of from about 2,500 to about 6,500 Mega Pascals and a break strength of from about 50 to about 90 Mega Pascals.

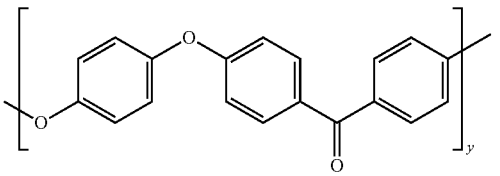

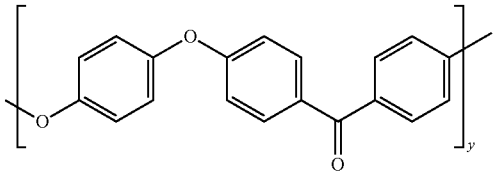

3. An intermediate transfer member in accordance with claim 1 with a crosslinking percentage subsequent to curing being from about 70 to about 90 percent, and wherein alkyl contains from 1 to about 10 carbon atoms and aryl contains from 6 to about 24 carbon atoms.

4. An intermediate transfer member in accordance with claim 1 wherein said crosslinked poly(ether ether ketone) is selected from the group consisting of those represented by the following formulas/structures

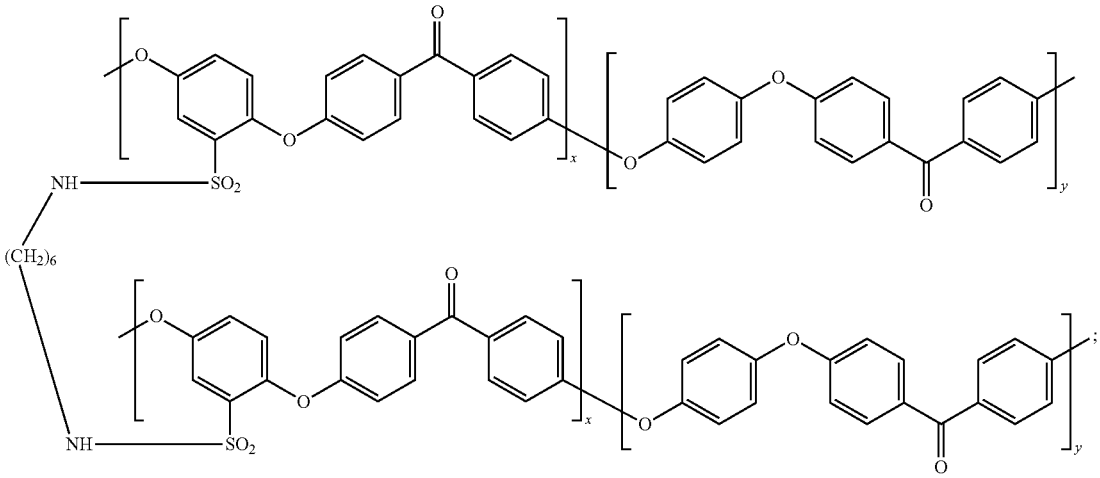

-continued

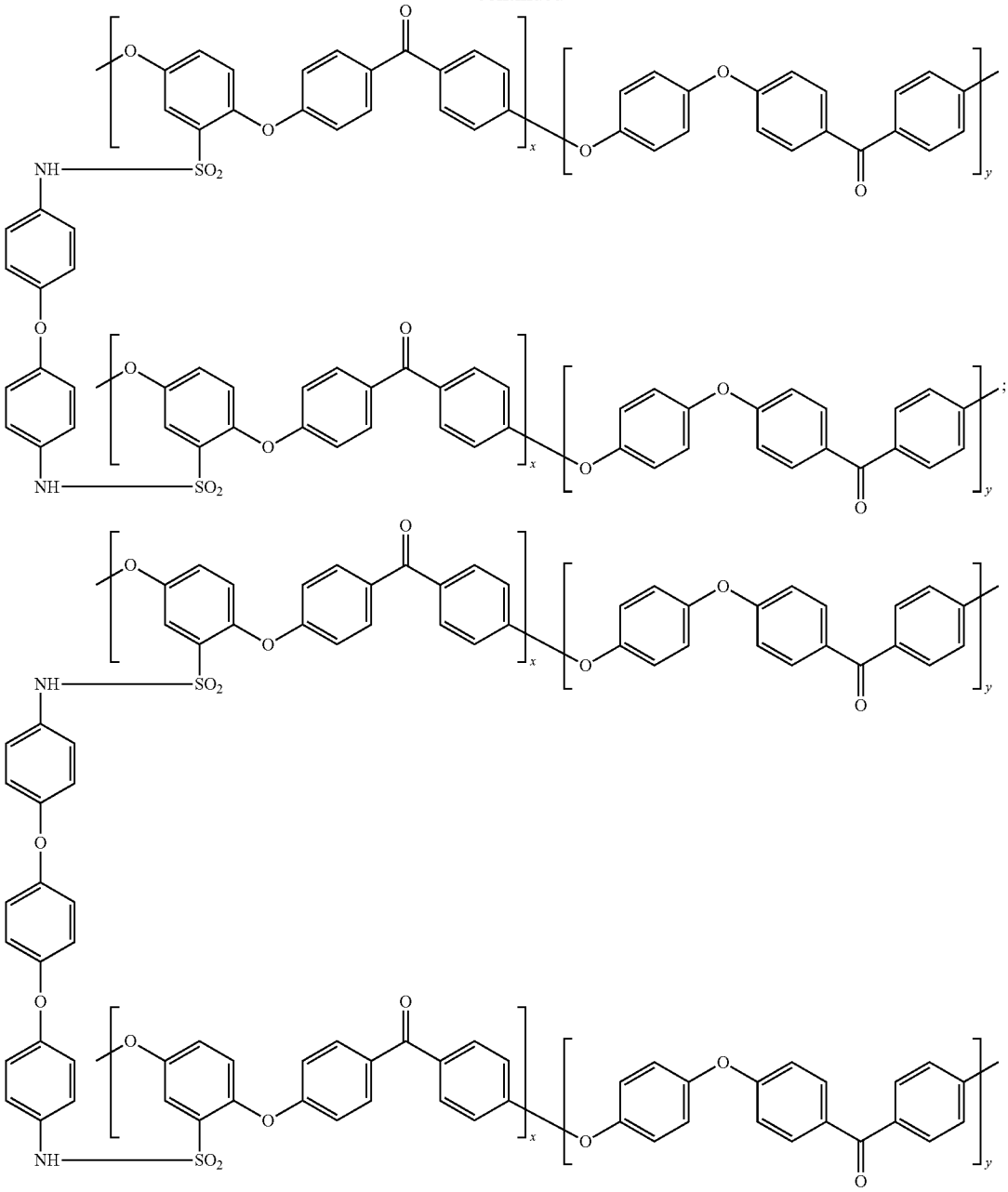

where x is from about 30 to about 80 mole percent, y is from about 20 to about 70 mole percent, and the sum of x plus y is equal to about 100 mole percent.

5. An intermediate transfer member in accordance with claim 1 further including therein a conductive component selected from the group consisting of carbon black, a metal oxide, a polyaniline, and mixtures thereof.

6. An intermediate transfer member in accordance with claim 1 wherein said crosslinked poly(ether ether ketone) is present in an amount of from about 60 to about 97 weight percent based on the ingredients present, and further containing a conductive component therein, wherein said conductive component is present in an amount of from about 3 to about 40 weight percent based on the ingredients present, and wherein the total thereof is about 100.

7. An intermediate transfer member in accordance with claim 1 further containing a polysiloxane and an internal release additive.

8. An intermediate transfer member in accordance with claim 7 wherein said polysiloxane is selected from the group consisting of a polyether modified polydimethylsiloxane, a polyester modified polydimethylsiloxane, a polyacrylate modified polydimethylsiloxane, a polyester polyether modified polydimethylsiloxane, and mixtures thereof.

9. An intermediate transfer member in accordance with claim 7 wherein said polysiloxane is present in an amount of from about 0.01 to about 1 weight percent of the total solids, and said internal release additive is present in an amount of from about 0.2 to about 2 weight percent of the total solids.

10. An intermediate transfer member in accordance with claim 1 wherein said crosslinked poly(ether ether ketone) is soluble in a solvent selected from the group consisting of dimethyl sulfoxide, acetone, N-methyl-2-pyrrolidone, N,N-dimethylformamide, N,N-dimethylacetamide, and mixtures thereof.

11. An intermediate transfer member in accordance with claim 1 wherein said crosslinked poly(ether ether ketone) possesses a weight average molecular weight of from about 80,000 to about 250,000, and a number average molecular weight of from about 40,000 to about 150,000 as determined by Gel Permeation Chromatography.

12. An intermediate transfer member in accordance with claim 1 wherein said crosslinked poly(ether ether ketone) possesses a weight average molecular weight of from about 120,000 to about 180,000, and a number average molecular weight of from about 60,000 to about 100,000 as determined by Gel Permeation Chromatography.

13. An intermediate transfer member in accordance with claim 1 wherein said conductive component is present and further including a polysiloxane, and an optional internal release additive, wherein said crosslinked poly(ether ether ketone) is represented by the following formulas/structures and wherein the crosslinking percentage subsequent to curing is from about 50 to about 99 percent as determined by Fourier Transform Infrared Spectroscopy (FTIR)

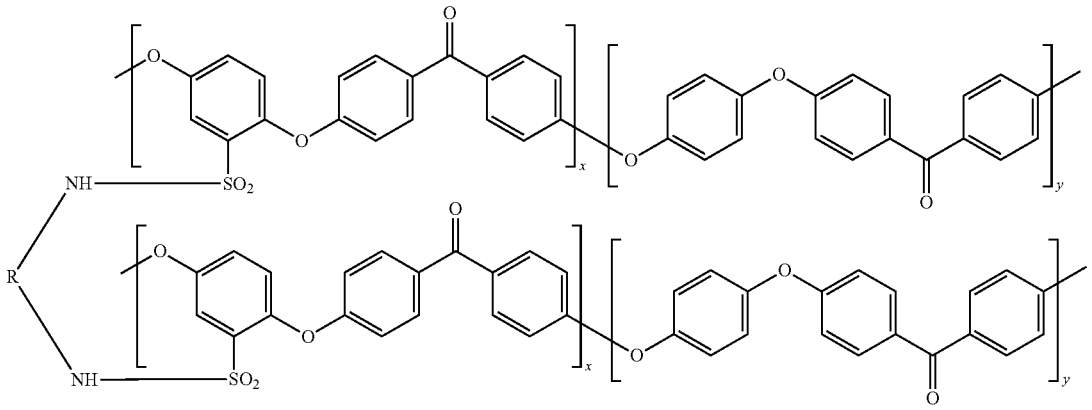

where x and y are the mole percent of the repeating units; x is from about 10 to about 95 mole percent; y is from about 5 to about 90 mole percent, and the sum of x plus y is equal to about 100 mole percent; and R is alkyl, aryl, or substituted derivatives thereof.

14. An intermediate transfer member in accordance with claim 13 wherein x is from about 30 to about 80, and said crosslinking percentage is from about 70 to about 90 percent.

15. An intermediate transfer member in accordance with claim 13 wherein said member possesses a Young's Modulus of from about 2,500 to about 6,500 Mega Pascals.

16. An intermediate transfer member in accordance with claim 13 wherein said member possesses a break strength of from about 50 to about 90 Mega Pascals.

17. An intermediate transfer member in accordance with claim 13 wherein said member possesses a Young's Modulus of from about 2,800 to about 3,100 Mega Pascals, and a break strength of from about 50 to about 75 Mega Pascals.

* * * * *